United States Patent [19]

Boyle

[11] 4,200,193

[45] Apr. 29, 1980

[54] EASY OPENING, RECLOSEABLE BLISTER CARD CONTAINER

[75] Inventor: Daniel J. Boyle, Hartland, Wis.

[73] Assignee: Champion International Corporation, Stamford, Conn.

[21] Appl. No.: 17,604

[22] Filed: Mar. 5, 1979

[51] Int. Cl.[2] ..... B65D 75/36; B65D 75/58

[52] U.S. Cl. ..... 206/461; 206/467; 206/470; 206/621; 229/45 R

[58] Field of Search ..... 206/470, 461, 621, 467, 206/626; 229/2.5 R, 45

[56] References Cited

U.S. PATENT DOCUMENTS

| | | | |
|---|---|---|---|
| 3,174,621 | 3/1965 | Watson | 206/470 |
| 3,262,632 | 7/1966 | Brady et al. | 206/621 |
| 3,599,787 | 8/1971 | Webster, Jr. | 206/621 |
| 3,948,391 | 4/1976 | Beaman | 206/461 |

*Primary Examiner*—William T. Dixson, Jr.
*Attorney, Agent, or Firm*—Evelyn M. Sommer

[57] ABSTRACT

An easy opening recloseable blister card container includes a thermoformed blister receptacle bonded to the face of a card which includes a hingedly attached closure flap defined by perforated score lines in the card. The closure flap includes a locking tab integral therewith defined by an arcuate cut line which is hinged along a crease line in the flap and may be pivoted into overlapping relationship with a flange edge of the blister receptacle on the opposite side of the card to lock the closure flap in a closed position covering an opening in the card through which access to the blister receptacle is provided. A grip tab formed integral with the locking tab enables a user to initially tear the closure flap away from the card along the score lines and also provides a means of manipulating the locking tab to lock the closure flap in its closed position.

10 Claims, 8 Drawing Figures

EASY OPENING, RECLOSEABLE BLISTER CARD CONTAINER

TECHNICAL FIELD

This invention generally relates to packaging containers and deals more particularly with improvements in "blister" card type dispensing containers.

BACKGROUND AND BRIEF DESCRIPTION

Dispensing containers of the so called blister card type have gained widespread use for packaging and displaying relatively small articles such as pen cartridges or other small parts. Typically, these containers are of a two piece construction and comprise a small sheet of paperstock forming a card, and a transparent sheet of plastic film which is thermoformed into an open topped receptacle or "blister" which is filled with product and then bonded by any of various means to one face of the card which forms a closure wall over the receptacle. The card usually is provided with an aperture therein to allow the container to be hung in a display arrangement and also is often provided with a perforated scored section adjacent the plastic receptacle to allow the ultimate user to gain easy access to the packaged articles without the need for tearing the blister away from the card. Once the scored section is broken by a user, however, the resulting access opening in the container remains open to some extent and may result in some of the packaged articles being lost when the container is stored during periods of non use. Because the costs of a packaging container of the type described above are often relatively high in comparison to the value of the packaged articles, prior art approaches to providing lockable closure means for closing blister cards have not been employed due to the additional costs and/or complexity which would result. Consequently, there is a need in the packaging art for a blister card construction which includes an effective, inexpensive lockable closing means but yet which allow easy opening of the container.

The present invention satisfies the need mentioned above by providing an easy opening, recloseable blister card construction which is both simple and economical in terms of fabrication costs. The container of the present invention comprises a card portion formed from a blank comprising a single sheet of paper stock, and a receptacle portion thermoformed from a single sheet of plastic which is bonded to one face of the card to form a packaging enclosure. The card includes an access opening therein, in registration with the receptacle, which is defined by a rectangular closure flap having one edge thereof joined by a fold line to the panel. The closure flap includes a locking tab integral therewith defined by an arcuate cut line which is hinged along a crease line in the closure flap and may be pivoted into overlapping relationship with an edge of the plastic receptacle on the other side of the card to lock the closure flap in a closed position covering the access opening. A grip tab formed integral with the locking tab enables a user to initially tear the closure flap away from the card along the score lines and also provides a means of manipulating the locking tab to lock the closure flap in the closed position.

BRIEF DESCRIPTION OF THE DRAWINGS

In the drawings which form an integral part of the specification and are to be read in conjunction therewith, and in which like numerals are employed to represent like parts in the various views.

DETAILED DESCRIPTION OF THE INVENTION

Figure 1:
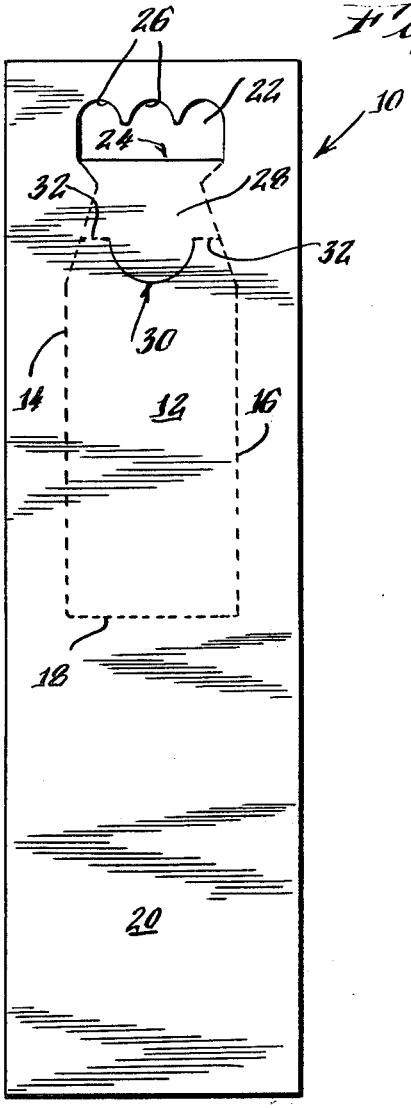
FIG. 1 is a plan view of a blank for forming the card portion of the present invention.
Figure 2:
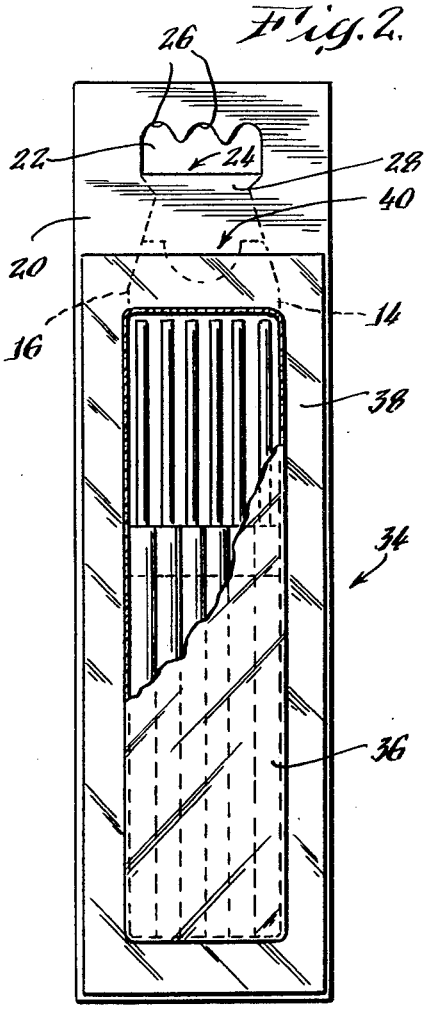
FIG. 2 is a front view of the dispensing container filled with product, parts being broken away in section for clarity, which forms the preferred embodiment of the present invention.
Figure 3:
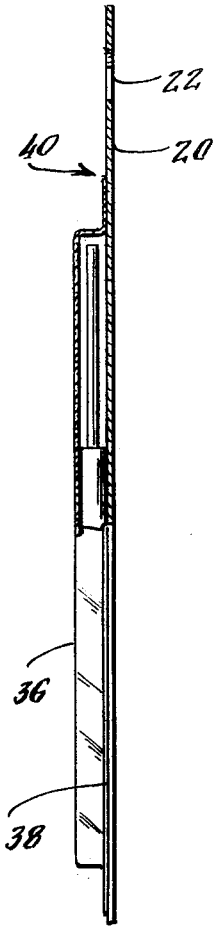
FIG. 3 is a longitudinal side view, partially in section of the container of FIG. 2.
Figure 4:
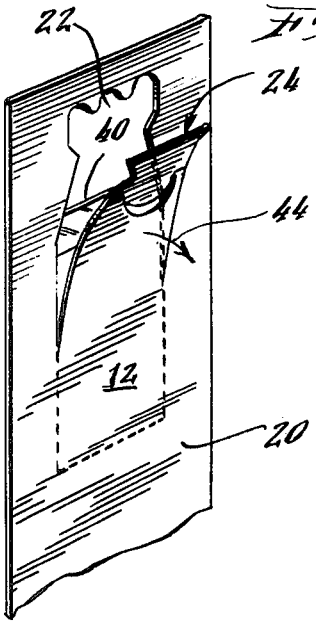
FIG. 4 is a perspective view of the container empty of product, showing the closure flap thereof being initially pulled away from the card portion to open the container.
Figure 5:
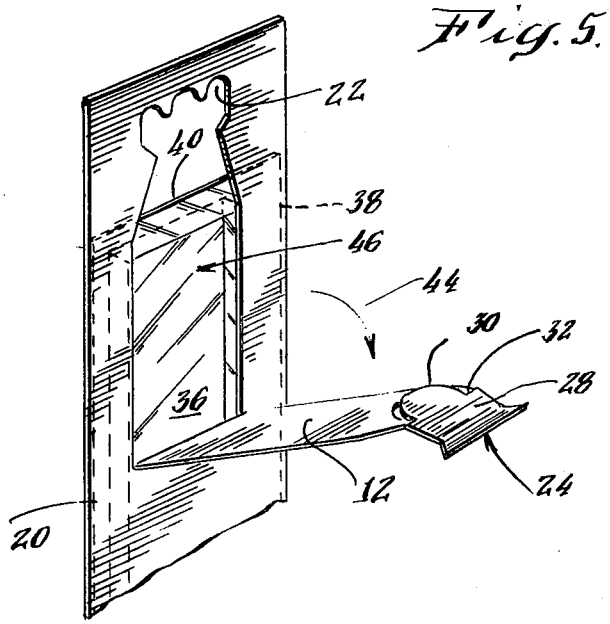
FIG. 5 is a view similar to FIG. 4 but showing the closure flap in a fully opened position to allow product to be removed from the container.
Figure 6:
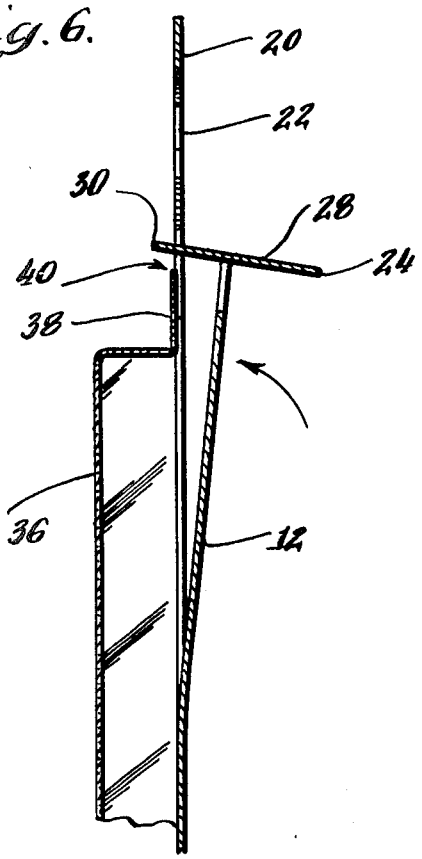
FIG. 6 is a longitudinal sectional view taken from one side of the container showing the closure flap in the closed position thereof with the locking tab pivoted to a generally horizontal position just prior to locking the closure flap.
Figure 7:
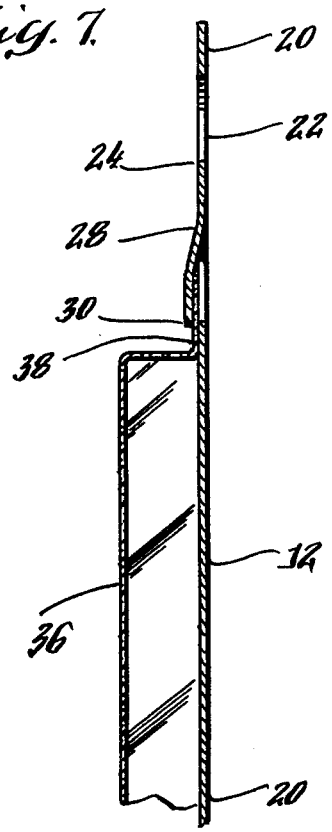
FIG. 7 is a view similar to FIG. 6 but showing the locking tab disposed in a locked position.

Referring first to FIG. 1, a dispensing container is formed in part from a blank, generally indicated by the numeral 10, comprising a single unitary sheet of paperstock. The blank 10 is essentially rectangular in shape and is provided with an essentially rectangularly shaped closure flap 12 in central areas thereof which has two edges defined by parallel perforated score lines 14 and 16 and is hingedly joined along another edge thereof by a fold line 18 to the surrounding region of the blank which forms a card 20. In the instant embodiment, an aperture 22 is provided in one end of the card 20 which is defined in part by the fourth edge 24 of the closure flap 12 and is essentially aligned with the longitudinal axis of the closure flap 12. Aperture 22 includes a serpentine edge 26 on one side thereof opposite the edge 24.

One end of closure flap 12 distal from fold line 18 includes a tapered portion 28 defined by V-shaped sections in the score lines 14 and 16. Tapered portion 28 includes a locking tab defined by an arcuate cut line 30 which has the opposite extremities thereof extending from a crease line 32 in a direction toward the fold line 18. Crease line 32 extends transversely across the closure flap 12 between the score lines 14 and 16, and is essentially parallel to the edge 24 and fold line 18.

Referring now also to FIGS. 2—7, an easily opened dispensing container 34 comprises an enclosure including a receptacle portion 36 and a card portion 20 joined thereto which forms one wall of the enclosure. The receptacle portion 36 is preferably a thermoformed blister of transparent plastic material, herein shown as rectangularly shaped, having a flat flange 38 surrounding the periphery thereof. The open interior of the receptacle portion 36 is in side-by-side registration with the closure flap 12. At least portions of the flange 38 are attached by any suitable means, such as thermobonding, to one side of the card 20. An upper lock edge 40 defined by a stretch of the flange 38 extends transverse to the closure flap 12 and is generally aligned with the crease line 32 or may be slightly spaced therebelow toward the fold line 18. Thus, the locking tab defined by arcuate cut line 30 is in side-by-side registration with the section of the flange 38 which provides locking edge 40.

Tapered portion 28 of the closure flap 12 includes a grip tab 42 adjacent edge 24 and the spacing between serpentine edge 26 and edge 24 will be sufficient to allow a user to grip opposite sides of the grip tab.

In use, product is inserted into the receptacle portion 36 after which the card portion 20 is bonded thereto. The container 34 may be suspended for retail display by inserting a supporting hanger (not shown) into the aperture 22. The serpentine edge 26 provides a plurality of choices of positions into which the hanger may be inserted to assure that the container assumes a level attitude during display. The ultimate user opens the closure flap 12 by gripping the grip tab and pulling the closure flap 12 rearwardly in the direction of the arrow 44 away from the card 20 about the fold line 18 whereupon the perforated score lines 14 and 16 joining the closure flap 16 and the surrounding card 20 are separated. With the closure flap 12 folded rearwardly to an open position, the user may remove a portion of the contents within the receptacle portion 36 through the resulting opening 46 in the card portion 20. In order to close and lock the closure flap 12, the user, while gripping the grip tab, pivots the free outer end of the closure flap 12 about the crease line 32 in a direction which swings the arcuate edge 30 toward the receptacle portion 36, until the edge 30 is disposed virtually horizontal as the closure flap 12 is swung back toward the card portion 20 until the edge 30 extends through the opening 46 in the card portion 20 and is disposed in a position extending transversely over the top of the lock edge 40. The grip tab is then pivoted back to its normal position essentially coplanar with the closure flap 12 whereby to place the locking tab defined by arcuate edge 30 into overlapping relationship with the lock edge 40 such that the latter is interposed between the closure flap 12 and the mentioned locking tab; at this point, the closure flap 12 is securely locked in place closing the opening 46 to prevent the accidental escape of product from the container 34. The tapered portion 28 of the closure flap 12 may be pivoted inwardly through the opening 46 a slight additional extent whereby the frictional engagement of the V-shaped edges of the tapered portion 28 and corresponding edges of the card portion 20 serve to prevent the tapered portion 28 from pulling away from the receptacle portion 36 to provide additional locking means to maintain the closure flap 12 in the closed position thereof.

To reopen the container 34, the user simply reverses the steps used to open the closure flap 12; the locking tab is pivoted into clearing relationship with lock edge 40 after which the closure flap 12 is swung rearwardly to expose the opening 46.

Figure 8:
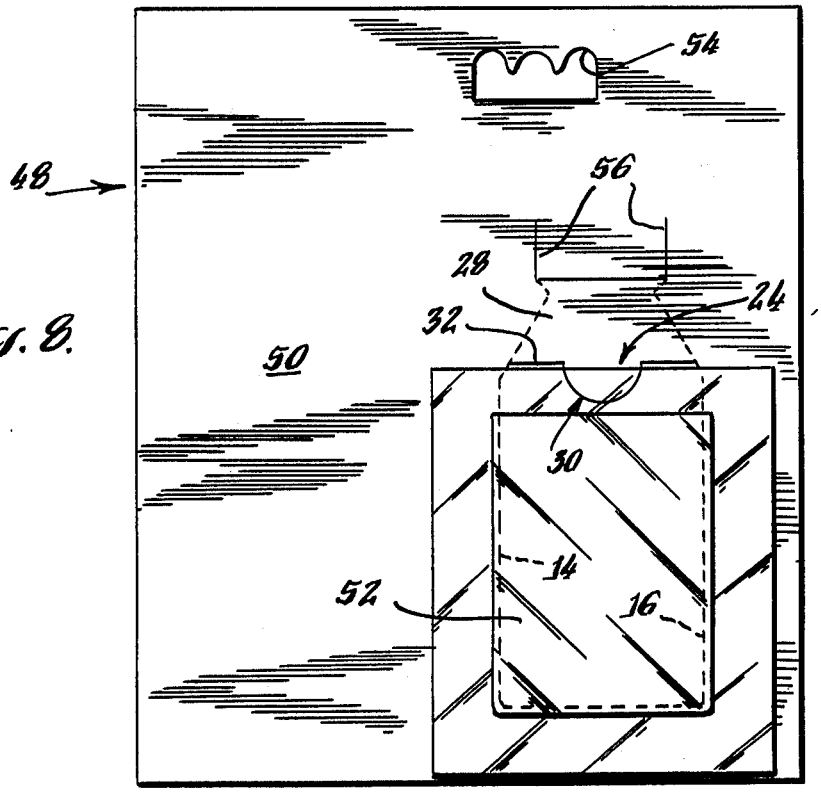
FIG. 8 is a front elevational view of an alternate form of the container.

A container 48, similar to the previously described container 34, is shown in FIG. 8. Container 48 includes a card portion 50 wherein both the closure flap 52 and the aperture 54 are offset from the vertical axis of the card portion 50 and from each other. Further, aperture 54 is spaced from the closure flap 52. Edge 24 of the tapered portion 28 is defined by a cut line in the card portion 50 while a pair of parallel cut lines 56 respectively extend from the opposite extremities of the edge 24 upwardly from the latter and provide a means for allowing the user to force a finger through the card portion 50 in order to grip the tapered portion 28.

From the foregoing, it will be observed that the present container not only provides for the reliable accomplishment of the object of the invention, but does so in a simple and economical manner. It is recognized, of course, that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

What is claimed is:

1. A container provided with a closable opening therein, comprising:

an enclosure including a plastic blister having first, second, third and fourth edges defining the perimeter thereof, said enclosure further including a rigid unitary card fixedly attached to marginal areas of said blister along essentially the entire length of said first, second and third edges of said blister whereby to define a wall of said enclosure, said card being provided with a continuous opening therein extending from one side of said fourth edge of said blister to the opposite side of said fourth edge whereby to define a first open portion in said card in registration with said blister to allow access to said enclosure and a second open portion in said card contiguous with said first open portion and adjacent said blister, peripheral portions of said card essentially completely circumscribing said continuous opening whereby to provide a rigid border therearound, said card having a closure flap integral therewith which is swingable about a fold line in said card from a closed position covering said first open portion in said card wherein said closure flap is essentially coplanar with said card and an open position allowing access to the interior of said enclosure through said first open portion of said card, one extremity of said closure flap distal from said fold line including a locking tab formed integral therewith and extending partially into said second open portion of said card whereby to provide access to said locking tab, said locking tab being shiftable toward and away from the plane of said flap about a crease line in the latter, said fourth edge of said blister defining a lock edge extending transverse to said closure flap and in registration with said locking tab when said closure flap is in said closed position thereof, said locking tab being shiftable to a position on one side of said lock edge opposite said closure flap whereby said lock edge is interposed between portions of said closure flap and said locking tab to lock said closure flap in said closed position thereof.

2. The container of claim 1, wherein said blister forms a receptacle having a plurality of flat flange strips extending around the periphery thereof which define said first, second, third and fourth edges of said blister, at least portions of said flange strips being bonded to one side of said card.

3. The container of claim 2, wherein said locking tab comprises an arcuately shaped edge defined by a cut line in central portions of said closure flap and extending from said crease line in a direction toward said fold line in said card.

4. The container of claim 3, wherein said closure flap further includes a grip tab extending from said crease line in said closure flap in a direction away from said locking tab and into said second open portion of said card, said grip tab and said locking tab being coplanar and simultaneously pivotable about said crease line.

5. The container of claim 4, wherein at least certain of the edges of said grip tab are defined by score lines in said card.

6. The container of claim 5, wherein said certain edges of said grip tab frictionally engage adjacent edges of said card along said score lines.

7. The container of claim 4, wherein said fold line, said crease line and said lock edge are essentially straight and are parallel to each other.

8. The container of claim 4, wherein said closure flap is provided with V-shaped opposing edges defined by score lines in said card adjacent said one extremity of said closure flap.

9. A blank comprising a single sheet of paperstock for forming the card of claim 1.

10. A container provided with a closable opening therein, comprising:

an enclosure including a plastic blister having a plurality of margins defining the perimeter thereof, said enclosure further including a unitary card fixedly attached to more than one of said plurality of margins of said blister whereby to define a wall of said enclosure, said card being provided with an opening therein in registration with said blister and completely circumscribed by peripheral portions of said card, said card further including a closure flap integral therewith which is swingable about a fold line in said card from a closed position covering said opening and an open position allowing access to the interior of said enclosure through said opening therein, one extremity of said closure flap distal from said fold line including a locking tab formed integral therewith and shiftable toward and away from the plane of said closure flap about a crease line in the latter, one of said margins defining a lock edge extending transverse to said closure flap and in registration with said locking tab when said closure flap is in said closed position thereof, said locking tab being shiftable to a position on one side of said lock edge opposite said closure flap whereby said lock edge is interposed between portions of said closure flap and said locking tab to lock said closure flap in said closed position thereof, said card further including an access flap therein defined by a first cut line in said card spaced from said crease line in a direction away from said fold line, and second and third cut lines in said card communicating with said first cut line and extending away from said first cut line in a direction away from said crease line, said access flap being shiftable out of the plane of said card to permit access and gripping by a user of said locking tab.

* * * * *